United States Patent [19]

Stein

[11] Patent Number: 4,756,038

[45] Date of Patent: Jul. 12, 1988

[54] MACHINE FOR AUTOMATICALLY ROUGHING THE CEMENT MARGIN OF A FOOTWEAR UPPER ASSEMBLY

[75] Inventor: Martin L. Stein, Bedford, Mass.

[73] Assignee: International Shoe Machine Corporation, Nashua, N.H.

[21] Appl. No.: 99,701

[22] Filed: Sep. 21, 1987

Related U.S. Application Data

[63] Continuation of Ser. No. 876,561, Jun. 20, 1980, abandoned.

[51] Int. Cl.[4] ..... A43D 95/00; C14B 1/44

[52] U.S. Cl. ..... 12/1 R; 12/77; 69/6.5

[58] Field of Search ..... 12/1 R, 70, 77, 78, 12/17.2; 69/6.5

[56] References Cited

U.S. PATENT DOCUMENTS

| | | | |
|---|---|---|---|
| 3,518,851 | 1/1970 | Boot et al. | 69/6.5 |
| 3,559,428 | 2/1971 | Babson | 69/6.5 |
| 3,579,695 | 5/1971 | Boot et al. | 12/127 |
| 3,645,118 | 2/1972 | Babson | 69/6.5 |
| 3,704,604 | 12/1972 | Boot et al. | 69/6.5 |
| 3,843,985 | 10/1974 | Leonhardt | 12/1 R |
| 3,932,907 | 1/1976 | Vornberger | 12/1 R |
| 3,975,932 | 8/1976 | Vornberger | 69/6.5 |
| 3,992,743 | 11/1976 | Vornberger | 12/1 R |
| 4,090,378 | 5/1978 | Sommer | 69/6.5 |
| 4,126,020 | 11/1978 | Tutt et al. | 69/6.5 |
| 4,126,021 | 11/1978 | Davies et al. | 69/6.5 |
| 4,167,103 | 9/1979 | Becka | 12/1 R |
| 4,331,011 | 5/1982 | Elliott et al. | 69/6.5 |
| 4,387,581 | 6/1983 | Reedman et al. | 69/6.5 |
| 4,389,861 | 6/1983 | Peck et al. | 69/6.5 |
| 4,391,011 | 7/1983 | Peck et al. | 12/1 B |
| 4,416,031 | 11/1983 | Shutt et al. | 69/6.5 |
| 4,452,057 | 7/1984 | Davies et al. | 69/6.5 |
| 4,555,823 | 12/1985 | Pedretti et al. | 12/77 |
| 4,561,139 | 12/1985 | Becka et al. | 12/1 R |
| 4,649,585 | 3/1987 | Petrzelka et al. | 12/17.2 |

FOREIGN PATENT DOCUMENTS

| | | |
|---|---|---|
| 1037211 | 8/1978 | Canada . |
| 1950363 | 8/1973 | Fed. Rep. of Germany . |
| 2077090 | 12/1981 | United Kingdom . |

OTHER PUBLICATIONS

Circular 983—Int'l Shoe Machine Corp.—Automatic Bottom Roughing Machine (Model C).

*Primary Examiner*—Steven N. Meyers
*Attorney, Agent, or Firm*—Robert Shaw

[57] ABSTRACT

Apparatus (and method) for automatically roughing the cement margin of a shoe or other footwear assembly, which footwear upper assembly includes an upper mounted on a last and an inner sole disposed upon the bottom of the last and connected to the upper. The apparatus (i.e., a roughing machine) typically includes a disc-shaped wire wheel (or other roughing tool) positioned with the plane of the brush approximately perpendicular to the cement margin at the region of contact between the two. The roughing machine includes a mechanism to receive the upper assembly and provide some combination of movements between the upper assembly and the periphery of the wire wheel to achieve a constant region (or area) of contact between the two as the cement margin moves with respect to the wire wheel in the course of roughing. The wire wheel is supported at one end of an intermediately pivoted action arm; a load measuring beam is connected to the other end of the action arm to provide electrical signals proportional to or representative of the pressure force between the wire wheel and the cement margin at the region of contact. A servo-valve actuated air cylinder drives the action arm to load the wire wheel upon the cement margin, the amount of loading being closely controllable (e.g., about one-half±psi) in response to the electrical signals which are connected as input to the servo-valve as control signals.

4 Claims, 4 Drawing Sheets

MACHINE FOR AUTOMATICALLY ROUGHING THE CEMENT MARGIN OF A FOOTWEAR UPPER ASSEMBLY

This application is a division, of application Ser. No. 876,561, filed June 20, 1980, now abandoned.

The present invention relates to machines for roughing the cement margin of a shoe or other footwear upper assembly.

By way of background attention is called to U.S. Pat. No. 4,561,139 (Becka et al) as well as the art cited therein.

In the course of shoe making a shoe (or other footwear) upper is mounted upon a last having an insole upon its bottom, the upper margin being draped over the last and stretched in the manner shown in the U.S. Pat. No. 4,391,012 (Becka), for example; an adhesive is thereafter applied to the margin of the upper which is then wiped to secure the margin to the bottom of the insole to form a shoe or other footwear upper assembly. Later the margin of the upper assembly is roughed, mostly manually even now, for later application of an outer sole. The Becka et al patent and others represent efforts in the shoe industry to provide roughing machines that emulate the manual roughing operation and do it better and more economically; however the change from manual to automatic is very difficult. Roughing is effected by applying a roughing tool to the cement margin of the upper assembly.

The bottom of a shoe upper assembly in plan view is irregular and characterized by a number of rather abrupt changes in shape. Also, the shoe assembly bottom typically is not planar, nor is there uniformity of contour gradient laterally from the edge of the sole inwardly toward its longitudinal axis (i.e., the crown). In addition shoe bottoms have abrupt longitudinal contour gradients from toe to heel. Any automatic roughing machine must follow those contour gradients while nevertheless achieving roughing of the cement margin only in an expeditious fashion. Furthermore, roughing of the margin only must be accomplished, since any slippage onto the side of the upper will ruin the shoe, except those that require side roughing. A most important issue in such roughing is providing a constant controllable force or pressure (i.e., pressure equals force per unit area) between the roughing tool and the cement margin to permit uniform removal of materials from the margin, i.e., ideally all of any one cement margin should have about the same amount of material removed from all parts of that cement margin.

Accordingly, it is an objective of the present invention to provide a machine for automatically roughing (i.e., a roughing machine) the cement margin of a footwear upper assembly to remove therefrom the smooth outer surface of leather or synthetic material and thereby enhance later bonding of the roughed footwear upper to an outer sole.

Another objective is to provide a roughing machine that provides removal of about the same amount of material by a roughing tool from all parts of that cement margin.

Another objective is to provide a roughing machine that permits very precise control of the force exerted by the roughing tool upon the cement margin in the course of roughing.

These and still further objectives are addressed hereinafter.

The foregoing objectives are achieved, generally, in a machine for automatically roughing the cement margin of a footwear upper assembly, that includes a support to receive the footwear upper assembly, which support is capable of rocking movement, translational movement and rotational movement; drive means connected to drive the support to achieve the rocking movement, translational movement and rotational movement of the support; a roughing tool mounted to move relative to the footwear upper assembly and operable to achieve roughing of the cement margin as the cement margin moves relative to the roughing tool in the course of rocking movement, translational movement and rotational movement; and pressure control means operable to assure a substantially constant (and controllable) force by the roughing tool upon the cement margin during the course of roughing.

The invention is hereinafter described with reference to the accompanying drawing in which.

Figure 1:
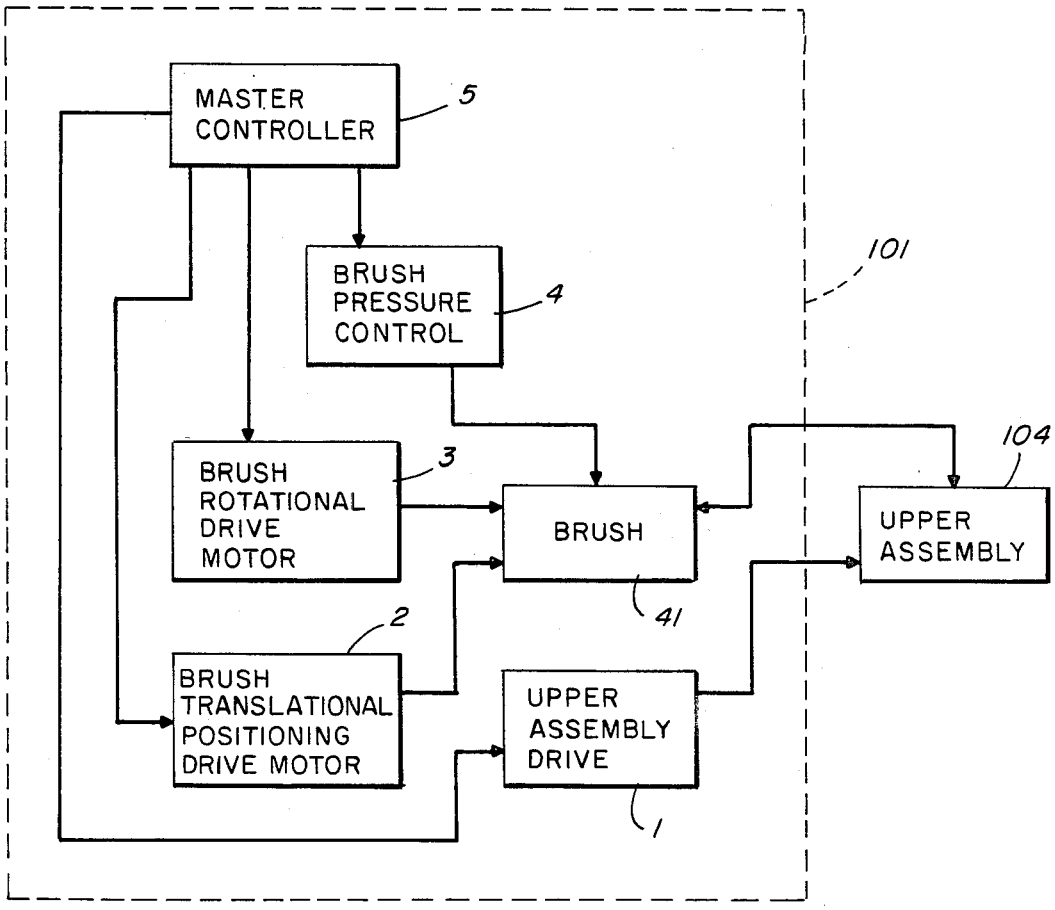
FIG. 1 is a diagrammatic representation of a roughing machine embodying the present inventive concepts.

Referring to the figures, the machine shown diagrammatically at 101 in FIG. 1 is one that automatically roughs the cement margin 103 of a footwear assembly 104 in FIGS. 2–5, as discussed in great detail in the Becka et al U.S. Pat. No. 4,561,139 aforementioned. The machine operator is intended to stand facing the machine (i.e., looking in the minus Z-direction in FIG. 6). Machine parts closest to the operator are considered to be at the front of the machine 101 and the machine parts furthest from the operator are considered to be at the back of the machine. Parts moving toward the operator are considered to have forward movement and parts moving away from the operator are considered to have rearward movement. The upper assembly 104, in the course of roughing, rotates about a vertical yaw-axis (i.e., the Y axis in the figures); it is subjected to translational movement (i.e., in the X-direction); and it is subjected to rocking movement (as indicated by the double arrow 107 in FIG. 2) about a Z-axis located at an intermediate position between the heel portion and the toe portion of the assembly 104. The machine 101 is now discussed in detail; in the discussion an attempt is made to point out the actual structures in later figures that correspond to the block elements in FIG. 1.

Figure 2:
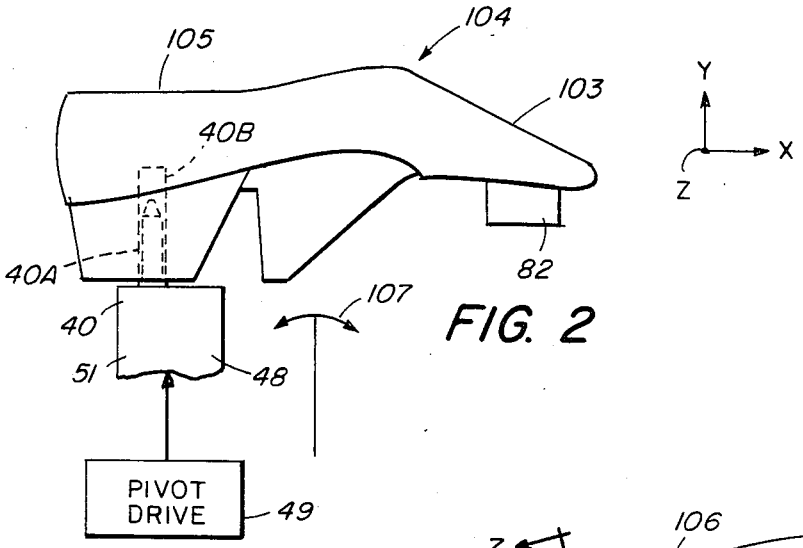
FIG. 2 is a side view of a footwear upper assembly and a few parts of the roughing machine.
Figure 3:
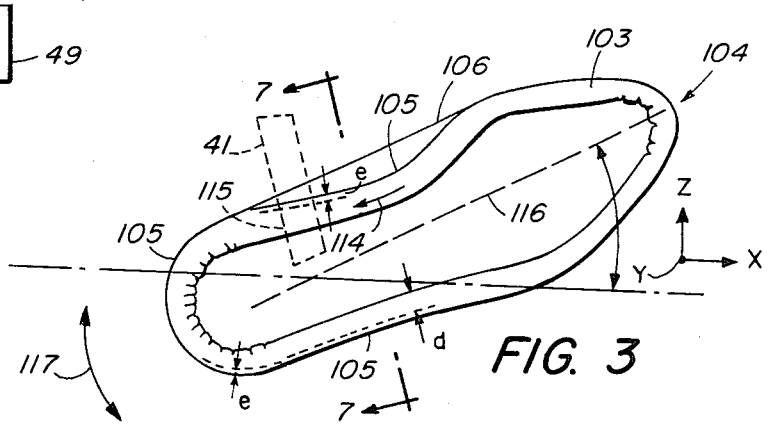
FIG. 3 is a plan view of the upper assembly of FIG. 2 plus a small part of a roughing tool, the upper assembly being rotated counterclockwise through about 30 degrees from the position shown in FIG. 2.

The roughing machine 101, as above indicated, serves to abrade the surface of the cement margin 103 (in FIG. 3) to provide enhanced bonding surface when an outer sole is later adhesively attached to the upper assembly. The margin 103, as shown in FIG. 3 is irregular in shape in the X-Z plane. The contour in the X-Y plane, as shown in FIG. 2 is irregular; also the sides of the upper assembly 104 present continuously differing surfaces to the various sensors, introducing additional problems. In the operation, in preferred form, the upper assembly 104 is rotated through 360 degrees to achieve roughing of one assembly 104 which is then removed; the next upper assembly is installed and rotation is again 360 degrees, but in the reverse direction.

The assembly 104 is received by a support 51 on a turret 48. The support 51 achieves rocking movement, rotational movement and translational movement by action of servomotors. Some of the servomotors are within the machine 101 first as in the figures in the Becka et al patent. Roughing of the cement margin 103 is effected by a roughing tool 41 which, in the disclosed embodiment, is a rotatable wire brush in the form of a disc whose plane of rotation (i.e., the Y-Z plane in the figures) is essentially vertically oriented and whose periphery or perhiperal surface 41A in FIG. 4 contacts the cement margin and roughs the same in the course of translational and other movements of the assembly 104 along a path that is essentially orthogonal to the axis of turret rotation (i.e., the Y-axis). A most important aspect of the invention disclosed in the Becka et al patent is the need to maintain a determined orientation between the roughing tool 41 and the footwear upper assembly 104 in the course of relative motion between the two, that determined orientation being such that the orientation between the roughing tool and the edge of the upper labeled 105 in FIG. 3 is maintained perpendicular to the edge 105 regardless of the position of the shoe assembly. (The edge 105, as shown in FIG. 3 and elsewhere, is irregular in direction and is linear at some places and curved in others along its closed-in loop path or track; it will be understood in the explanation herein that the brush 41, or the plane of the disc-shaped brush, is maintained perpendicular to the edge 105 where the edge is linear and to the tangent to that edge where the edge is curved.)

The upper assembly 104 in FIG. 2 is connected to the roughing machine by a last pin 40A (or other clamping mechanism) which is received by a thimble hole 40B. The last pin 40A extends upwardly from the pivot arm or spindle 40 which, as shown in the Becka et al patent, is part of the turret 48 which provides rocking movement, translational movement and rotational movement. A mechanism within the turret 48, designated pivot drive in FIG. 2, rotates the upper assembly 104 clockwise so that the toe thereof is pressed upon a toe rest 82. At that juncture the upper assembly 104 is secured to the roughing machine 101. To release the upper assembly, the downward pressure by the toe upon the toe rest 82 is removed, this being done after the cement margin has been roughed.

The mechanism for supporting the upper assembly 104 is an upper assembly drive in FIG. 1. The drive 1 includes, as one part thereof, the turret 48 (see the Becka et al patent for details of one embodiment) which is capable of applying to the upper assembly 104 a combination of rocking movement (see arrow 107 in FIG. 2), translational movement and rotational movement (see arrow 117 in FIG. 3) during the course of which the cement margin is roughed by the wire brush 41. The combination of movements serves continuously to present a new roughing surface to the wire brush 41 in the course of roughing to present an essentialy constant contact area (or region) 115 in FIG. 3 between the roughing wheel 41 and the cement margin 103 in the course of roughing and, hence, to result in uniformity of roughing. The present invention is directed to providing a way to assure a substantially constant pressure where pressure, for example, in pounds per square inch equals the force divided by the area in square inches of the contact region 115 between the roughing wheel 41 and the cement margin 103 at the region contact 115 therebetween. The combination of movements afforded by the turret 48 serves, among other things, to cause the roughing wheel 41 to continuously track the cement margin 103 with a determined and substantially constant orientation between the cement margin and the rough wheel as the cement margin moves past the roughing portion of the roughing wheel. The rotational movement includes angular indexing movement of the upper assembly in the course of roughing between the toe portion and the heel portion of the upper assembly to maintain the determined orientation constant despite direction changes of the cement margin between the toe portion and the heel portion. The rocking movement in the machine in Becka et al is about a transverse axis of the footwear upper assembly located intermediately between the heel portion and the toe portion thereof. The rocking movement serves to maintain the cement margin being roughed at all times essentially parallel to the region of contact 115, that is, the contact portion of the roughing wheel 41 is flattened at the region of contact to form a region of contact 115 which is rectangular and parallel to—indeed in contact with—a similar rectangular region of the cement margin. Conceptually the region of contact 115 can be viewed either from the wheel 41 or the cement margin 103. Also, ideally and, in fact, as a necessity to maintain the constant area—the loading force F of the brush 41 upon the cement margin 103 must be substantially constant through a roughing cycle. It is toward maintaining that loading force F substantially constant that the present invention is directed—a non-trivial problem when one considers, among other things, problems of inertia in a machine like the machine 101. It should be noted, however, that the force F can be adjusted up or down (i.e., increased or decreased) to give a satisfactory roughed surface, it being further noted that after adjustment the force is substantially constant throughout the cycle. It will be further appreciated that the area 115 varies in size as a function of the forc F, but it is related and once adjusted to satisfy roughing requirement for an upper assembly can be, according to the present teachings, maintained within close limits. Turning now to FIG. 1, a number of operating units touched on before are now discussed.

Figure 4:
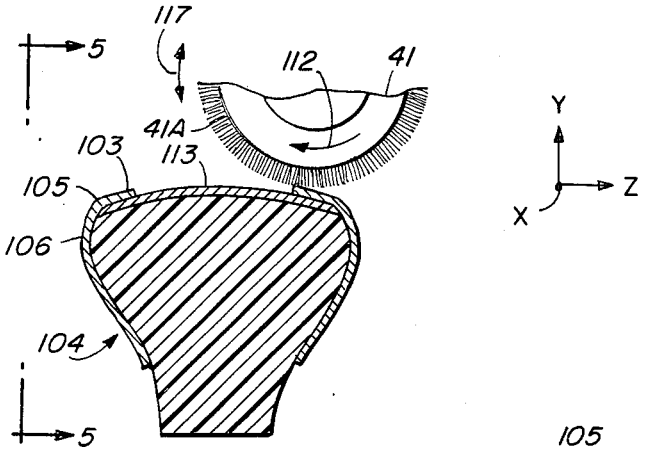
FIG. 4 is a view on the line 4—4 in FIG. 3 looking in the direction of the arrows.
Figure 5:
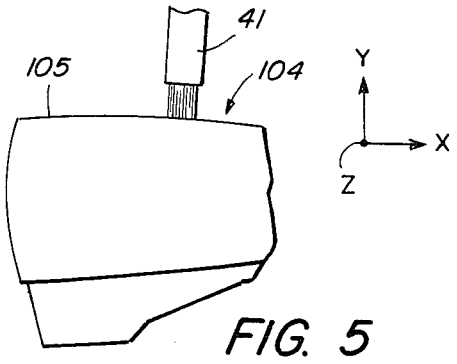
FIG. 5 is a view on the line 5—5 in FIG. 4 looking in the direction of the arrows.

The brush 41 is driven by a brush rotational drive motor 3 in the direction of the arrow labeled 112 in FIG. 4 to achieve roughing.

The brush 41 is moved translationally (i.e., in ±Z-direction in FIG. 4) toward and away from the crown 116 in FIG. 3 by a brush translational positioning drive motor 2. Weight of the brush, in the absence of other intervening structures, applies some downward force between the brush 41 in FIG. 1 and the cement margin of the upper assembly 104. A master controller 5 orchestrates all the operators herein discussed; see the Becka et al patent for further details. The remainder of the specification is devoted mostly to the brush pressure control designated 4 in FIG. 1, with reference mostly to FIG. 6.

The roughing tool 41 in the figures is illustrated as a disc-shaped wire brush wheel (but need not be) whose brush plane is maintained essentially perpendicualr to the edge 105 of the footwear assembly 104 during roughing. The brush is moved up and down (or away from and toward the cement margin) in the direction of the arrow labeled 117 in FIGS. 4 and 6 by a double-acting pneumatic cylinder, as later discussed, which exerts an essentially constant loading force between the brush and the cement margin. That loading force is maintained despite irregularities in the cement margin 103 and other factors that tend to effect pressure changes between the wire wheel 41 and the cement margin 103 in the course of a roughing cycle.

Figure 6:
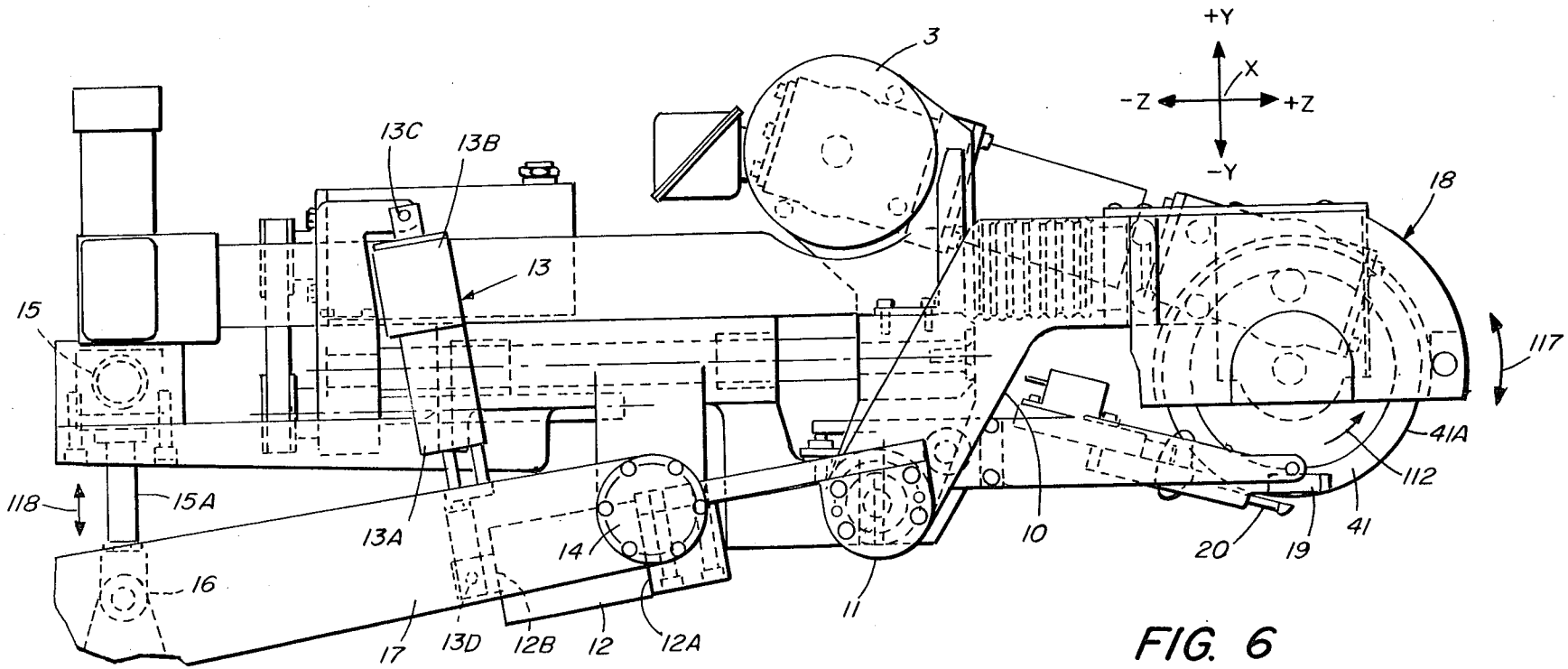
FIG. 6 is a side view of the roughing tool and closely related mechanisms that function to assure constant force by the roughing tool on the cement margin of an upper in the course of roughing.
Figure 7:
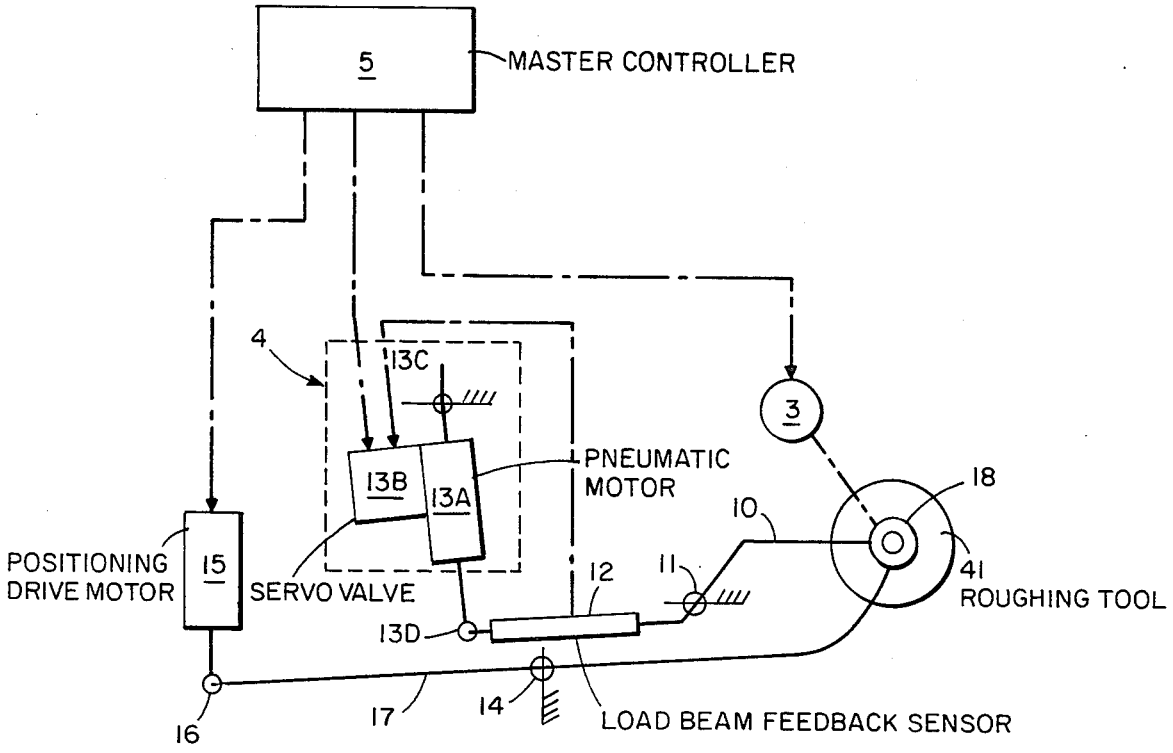
FIG. 7 is a schematic representation of the arrangement depicted in FIGS. 1 and 6.

The roughing wheel 41 is rotatably supported by an action lever arm 10 in FIG. 6, the roughing wheel being journalled to the action arm 10 at one end of the arm which has an intermediate pivot 11 and supports a load measuring beam or force transducer or strain indicator 12 at the other end thereof. The load measuring beam 12, sometimes referred to in the literature as a bending beam weigh cell, forms part of the pressure control mechanism or brush pressure control 4 (FIG. 1) which further includes a pneumatic cylinder 13A and an electrically actuated servo valve 13B in FIG. 6 that perform two distinct, but related, functions, as noted below, but they are both contained in a single or unitary device 13 to maintain their necessary structural relationship with closely-related active parts to give low mechanical impedance and hence fast reaction time.

The unitary device 13 is pivotally connected to the machine at end 13C thereof and is pivotally connected to the load measuring beam 12 at the other end 13D thereof. The pneumatic cylinder 13A is double acting and moves the brush up and down in FIG. 6 in the directions indicated by the arrow 117. The actual pneumatic cylinder used can apply up to about sixty pounds of downward force onto the cement margin by the roughing wheel and that force can be reduced to zero or below (i.e., up to about forty pounds of upward force). The moment of inertia of the action arm 10 and associated parts (e.g., the roughing wheel 41) must be low enough such that the roughing wheel 41 can be made to track undulations in the roughing surface of the cement margin during roughing to assure uniform removal of material from that roughing surface.

The load measuring beam 12 is rigidly anchored to the machine 101 at one end 12A thereof and is pivotally connected to the unitary device 13 at the other end 12B thereof. Forces on the roughing wheel 41 at the roughing surface exerted by the cement margin tend to pivot the action arm 10 counterclockwise in FIG. 6 about the pivot 11; those forces are transmitted to the load measuring beam 12 which provides electrical feedback signals indicative of the forces. Said another way, movement of the roughing wheel 41 in FIG. 6 in a small arc about the pivot point 11 (in the direction of the arrow 117) causes forces on the load measuring beam 12 which converts those forces to electrical signals proportional to the forces applied to the load measuring beam 12. The electrical signals are connected as input to the servo-valve portion 13B of the unitary structure 13. The input electrical signals cause the servo-valve portion to control or modulate air into the pneumatic cylinder portion 13A which applies appropriate small forces upon the action arm 10, thereby to apply the proper force by the wheel 41 upon the cement margin 103. That force can be changed by input signals to the master controller 5 in FIG. 1 to achieve satisfactory removal rates at the interface between the brush 41 and the cement margin. The removal rate establishes the finished or roughed surface and depends on the results required for subsequent steps in the shoe-making process. In order to maintain the pressure force between the brush 41 and the cement margin 103, the unitary device 13 must act very quickly to changes in the electrical signal received from the strain gage 12. The unitary device 13 is capable of applying control forces on the brush-cement margin interface within plus-minus one-half pound in the course of a roughing cycle.

The arm 10 in FIG. 6 moves in the direction of the double arrow 117 in FIG. 6 about the pivot 11 in response to forces exerted thereon by the cylinder 13A through the load beam 12. It is a bending movement of the beam portion of the load beam 12 that provides the electrical signals that control the force F. All these movements and forces occur about the pivot 11, but there is another pivoting action about a pivot 14 occasioned by forces through a cylinder rod 15A of an air cylinder 15 which is pivotally connected at 16 to an arm 17. The arm 17, as above indicated, pivots at 14 to position the brush head labeled 18 relative to the cement margin of the upper assembly (not shown in FIG. 6). In so doing, rollers 19 press down upon the cement margin (see the Becka et al patent for a similar, but, not identical, arrangement). Finger sensors 20 (see the Becka et al patent) provide feedback signals to position the brush head 18 relative to the upper assembly and the cylinder 15 applies steady downward force between the rollers 19 and the cement margin; it is not the force F between the brush 41 and the cement margin. The force F is supplied by the cylinder 13A.

Modifications of the invention herein disclosed will occur to persons skilled in the art and all such modifications are deemed to be within the scope of the invention as defined by the appended claims.

What is claimed is:

1. In combination with a machine for roughing a cement margin (103) of a footwear upper assembly (104) on a moving support, including a motor driven roughing tool (41), means (2, 15, 16, 17) for positioning the roughing tool in loading contact with the cement margin, controller means (5) connected to the positioning means for establishing said loading contact during movement of the cement margin on the support relative to the roughing wheel and pneumatic means (13A) for app;lying a contact pressure force to the roughing tool during said loading contact, the improvement residing in means for correctively varying the contact pressure force to maintain contact pressure at a substantially steady level between the roughing tool and the cement margin despite surface undulations thereon, comprising force transmitting means (10, 11) for operatively connecting the pneumatic means to the roughing tool, feedback sensing means (12) connected to the force transmitting means for detecting deviations in the contact pressure independently of the positioning means and servo-control means (4) connecting the feedback sensing means to the pneumatic means for effecting said corrective variation in the contact pressure force in rapid response to said detection of the deviations in the contact pressure to prevent excessive deviation thereof from the steady level.

2. The combination of claim 1 wherein said steady level of the contact pressure is adjustable by the controller means.

3. The combination of claim 2 wherein said force transmitting means comprises a fixed pivot (11) and a lever mounted on the pivot having opposite arms respectively connected to the roughing tool and the pneumatic means, the feedback sensing means being mounted on one of the lever arms connected to the pneumatic means.

4. The combination of claim 1 wherein said force transmitting means comprises a fixed pivot (11) and a lever mounted on the pivot having opposite arms respectively connected to the roughing tool and the pneumatic means, the feedback sensing means being mounted on one of the lever arms connected to the pneumatic means.

* * * * *

UNITED STATES PATENT AND TRADEMARK OFFICE

CERTIFICATE OF CORRECTION

PATENT NO. : 4,756,038

DATED : Jul. 12, 1988

INVENTOR(S) : Martin L. Stein

It is certified that error appears in the above-identified patent and that said Letters Patent are hereby corrected as shown below:

Front page, item 63 , change "1980" to: -- 1986 --.

Signed and Sealed this

Thirty-first Day of January, 1989

*Attest:*

DONALD J. QUIGG

*Attesting Officer*

*Commissioner of Patents and Trademarks*